United States Patent [19]

Zilges et al.

[11] 4,192,162

[45] Mar. 11, 1980

[54] METHOD AND APPARATUS FOR THE EXTRUSION OF TUBES OF EASILY OXIDIZED MATERIALS

[75] Inventors: Franz-Josef Zilges, Monchen-Gladbach; Heinrich Kutz, Neuss, both of Fed. Rep. of Germany

[73] Assignee: Schloemann-Siemag Aktiengesellschaft, Dusseldorf, Fed. Rep. of Germany

[21] Appl. No.: 937,773

[22] Filed: Aug. 29, 1978

[30] Foreign Application Priority Data

Sep. 3, 1977 [DE] Fed. Rep. of Germany ..... 2739800

[51] Int. Cl.[2] ..... B21B 45/02

[52] U.S. Cl. ..... 72/45; 72/38

[58] Field of Search ..... 72/38, 41, 43, 44, 45, 72/253, 264

[56] References Cited

U.S. PATENT DOCUMENTS

| | | | |
|---|---|---|---|
| 1,741,815 | 12/1929 | Boynton . | |
| 1,995,258 | 3/1935 | Stockfleth . | |
| 2,025,666 | 12/1935 | Hanft . | |
| 2,252,365 | 8/1941 | Fisher | 72/4 |
| 2,551,710 | 6/1944 | Sanders . | |
| 2,865,502 | 12/1958 | Anscher . | |
| 3,157,282 | 11/1964 | Haendeler . | |
| 3,225,508 | 12/1965 | Simon . | |
| 3,767,748 | 10/1973 | Rosette | 264/89 |

FOREIGN PATENT DOCUMENTS

| | | | |
|---|---|---|---|
| 40-8813 | 5/1965 | Japan | 72/38 |

*Primary Examiner*—Leon Gilden

*Attorney, Agent, or Firm*—Holman & Stern

[57] ABSTRACT

A tube extrusion press extrudes tubes through the annular space formed when a mandrel projects into the aperture of an extrusion die. In order to prevent oxidation of the extruded product, the outside of the tube passes into a cooling section immediately downstream of the die, and a protective gas is blown into the interior of the tube through the mandrel which is hollow and has an opening in its tip. Both the inside and the outside of the tube may be coated with a liquid emulsion, and the hollow mandrel can have internal channels for the passage of a cooling liquid.

3 Claims, 5 Drawing Figures

METHOD AND APPARATUS FOR THE EXTRUSION OF TUBES OF EASILY OXIDIZED MATERIALS

The present invention relates to a method and to apparatus for the manufacture of extruded tubes from copper or similar easily oxidised materials by means of metal extrusion presses, particularly indirect metal extrusion presses, from heated, pre-pierced ingots through an annulus formed from a fixed or travelling mandrel and a die, whereby the tube formed passes through a cooling section acting on the tube from outside immediately downstream of the die.

In principle, the manufacture of tubes of e.g. aluminium and copper materials by direct and also by indirect extrusion processes is known. The practical requirement is for finished products, e.g. a copper tube, to be manufactured, with the product being produced in a simple way but, at the same time, meeting the highest criteria as to quality. It is therefore desirable to produce a copper tube the cross section and surfaces (inner and outer) of which, in particular, are free of oxide inclusions. Very narrow tolerances are to be achieved with a minimum of material input (billet weight) without the cost exceeding that of the now customary process for direct extrusion.

According to the invention, there is provided a method of extruding tubes of easily oxidised material from heated billets with central axial bores, through an annular gap formed by an extrusion die and the tip of a hollow mandrel positioned in the die, wherein the billet is placed in a billet container of an extrusion press, the mandrel is pressed into the billet, along the bore thereof to widen the bore; once the leading end of the mandrel has entered the die aperture, extrusion is begun, protective gas is blown into the interior of the hollow tube through the mandrel, and the extruded tube is cooled by a cooling section arranged immediately downstream of the die around the outside of the tube, the protective gas remaining inside the tube up to the end of the cooling section distant from the die.

Because the centre bore of the billet is initially narrow, before it is widened in the billet container by the mandrel, the bore is practically free of oxides. This centre bore serves as a guide bore during widening by the mandrel for precisely centering the mandrel in the die so that in producing the tube, the smallest tolerances can be achieved during extrusion. Further, the centre bore permits significantly larger billet lengths than can be applied to non-pre-pierced billets, since the mandrel is precisely guided by the centre bore when penetrating the material and the risk of the mandrel tip being off-centre in the die aperture is reduced.

The invention also provides a mandrel for an extrusion press for extruding tubes of easily oxidised material through an annular gap formed by an extrusion die and the tip of the mandrel, the mandrel being hollow and having an opening in its tip through which protective gas can be passed into the interior of the extruded tube.

In order to avoid oxidation both during and after the extrusion process, a given quantity of protective gas is passed through the inner tube of the mandrel and the hollowed mandrel tip into the inside of the tube being formed, from the commencement of extrusion. This ensures that the internal walling of the tube, which is cooled and no longer oxidisable at the end of the cooling section, cannot oxidise during the cooling process.

The cooling takes place, from the commencement of extrusion, on the outside of the tube only.

In this way, the centre bore in the billet allows not only the bore to be enlarged and the mandrel to be correctly centred but also the inside of the tube being formed to be filled immediately with protective gas through the tip of the mandrel. It is also possible for protective gas to be introduced axially into the inside of the tube being formed if the mandrel can travel directly into the die opening through a pierced billet, without widening the ingot. The (preferably indirect) extrusion and the flow pattern resulting in the material within the billet container in the direction of the die further ensures that any oxide particles that may be located on the surface of the billet are not forced into the material of the pipe but remain at its outer surface. Moreover, very thin butt-ends will result.

Since the surface of the tube is still very sensitive to oxidation immediately after extrusion and cooling, the extruded tube after passing through the cooling section may be sprayed on the outside with a lubricant emulsion. The emulsion is applied when the temperature of the tube is less than 60° C. This allows the extruded tube to be coiled without damage being done to the still highly sensitive upper surface of the tube through its various surfaces touching and rubbing against each other.

The diameter of the centre bore in the billet to be extruded should be greater than the diameter of the opening in the mandrel tip. In this way, when the mandrel tip penetrates the centre bore and when the centre bore is widened, no billet material can penetrate the opening at the mandrel tip as the mandrel moves forward. Further, this centre bore enables protective gas to be introduced through the hollowed mandrel tip into the inside of the tube being formed during the extrusion process. The mandrel tip may advantageously be semi-spherical in shape and proceed backwards into an adjoining cylindrical section whose external diameter corresponds to the internal diameter of the tube to be extruded. The semi-spherical shape of the mandrel tip in this way helps to improve cooling of the mandrel tip and the centering of the mandrel as it widens the centre bore of the billet.

The quantity of protective gas flowing into the inside of the tube being formed as a protection against oxidation is advantageously controllable via a shut-off valve, an adjustable throttle valve and a time switch. As a result, only sufficient protective gas is conveyed into the inside of the tube through the hollow mandrel tip for the inside of the tube to be filled with protective gas up to the end of the cooling section, i.e. up to the point where no further oxidation occurs because the tube has cooled. The protective gas can in this way be used sparingly because only one single filling of the inside of the tube being formed is necessary up to the end of the cooling section for each billet extruded, since on further extrusion of the billet the protective gas remains in this section and the part of the tube continuing on beyond the cooling section is not subject to further oxidation. Furthermore, when protective gas is supplied in this way, all facilities beyond the extrusion installation are easily accessible since no sealed, sizeable protective gas area is required, as in installations otherwise known.

The axial bore in the inside of the mandrel may expediently take the form of a double pipe up to the semi-spherical tip, the inner pipe serving to conduct the protective gas into the inside of the tube being formed, the annulus between the inner pipe and the outer pipe serving to supply cooling water or other liquid to cool the mandrel, and the annulus between the outer tube and the inner wall of the mandrel serving to remove the water within the mandrel.

Further, it may be advantageous for a given quantity of lubricant emulsion to be passed through the inner pipe of the mandrel, into the inside of the tube which has been extruded, and subsequently again expelled by air leaving a lubricant film on the inner walling of the extruded tube. This remaining lubricant film on the inside of the tube is of substantial importance in the drawing process following extrusion of the tube. Should the interior be lubricated only during the drawing process, the tube to be drawn might be easily torn since, in certain circumstances, lubrication is not uniform.

The invention will now be further described, by way of example, with reference to the accompanying drawings in which.

Figure 1:
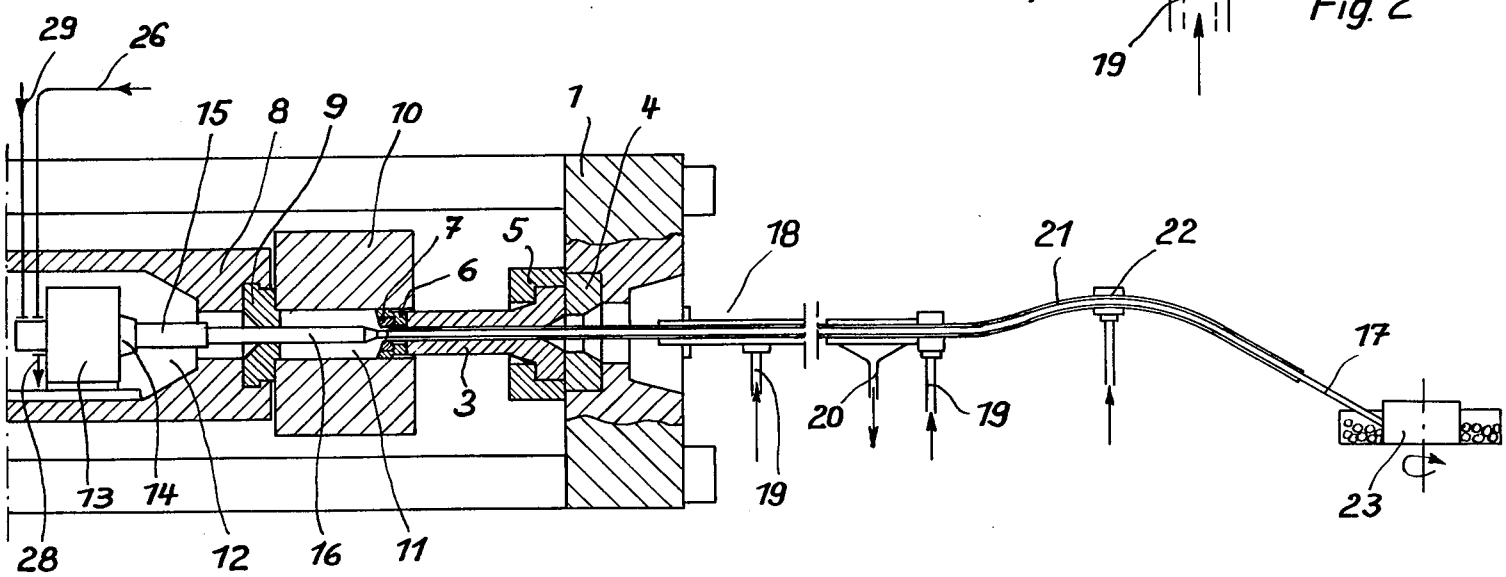
FIG. 1 is an elevation of part of an indirect metal extrusion and tube press with a cooling section located downstream of the die, the application of lubricant emulsion and the tube reel being shown in diagrammatic form.

In FIG. 1, a counter platen 1 of an indirect metal extrusion press is connected to a cylinder cross-head, not shown, by tie rods 2. A hollow stem 3 is supported on the side of the counter platen 1 facing the cylinder cross-head by a pressure plate 4, which is fastened by tool holders 5. A die 7 is fitted in a die holder 6 at the front end of the hollow stem 3. A moving cross-head 8 fastened to a press piston, not shown, bears on its side facing the counter platen 1 a sealing plate 9 which in turn lies against and seals one of the openings of the bore of a billet container 10. The bore of the billet container 10 contains a copper billet 11 for extrusion, which is pressed together with the billet container 10 against the hollow stem 3 and the die 7 by the moving cross-head 8.

Figure 3:
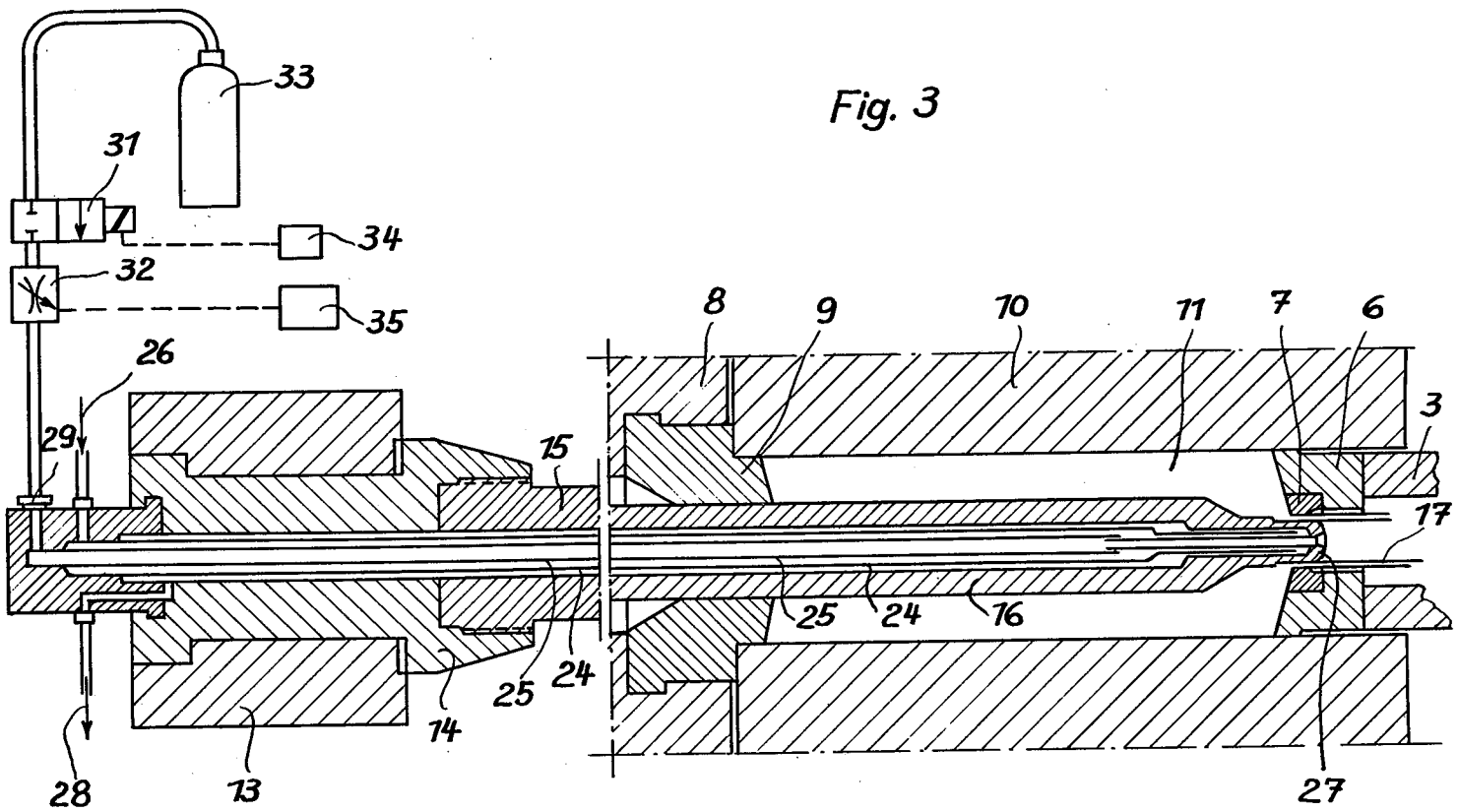
FIG. 3 is a longitudinal section of the mandrel with its tip within the die opening during extrusion of a tube.

In the escape 12, a crossover 13 sliding in the direction of extrusion and holding a mandrel holder carrier 14 (see also FIG. 3) is located in the moving cross-head 8 at right angles to the direction of extrusion. The mandrel holder carrier 14 is fitted with a mandrel holder 15 which in turn holds a mandrel 16. To extrude a billet 11 into a tube 17, the tip of the mandrel 16 is pressed through the billet 11, which is provided with a centre bore, into the opening of the die 7 and in doing so widens the bore and centres the billet.

Immediately downstream of the die 7 in the hollow stem 3 (see also FIG. 4) and continuing to beyond the counter platen 1, is a water cooling section 18 fitted with a cooling water input 19 and a cooling water outlet 20. Next, a guide tube 21 passes through a lubricant emulsion spray installation 22 for spraying the outside of the extruded copper tube 17 shortly before the tube 17 is coiled on a reel 23.

Within the hollow mandrel 16 (see FIG. 3) there is an outer pipe 24 and an inner pipe 25. Cooling water for cooling the mandrel 16 flows through a cooling water feed pipe 26 between the inner walling of the outer pipe 24 and the outer walling of the inner pipe 25 up to the mandrel tip 27. Here, the cooling water is diverted and now flows between the outer walling of the inner pipe 24 and the bore of the mandrel 16, cooling the mandrel 16, and back to a cooling water outlet pipe 28.

Protective gas is conveyed through the inner pipe 25 through a feed pipe 29 from the back of the mandrel holder carrier 14 to the mandrel tip 27 and flows through a bore 30 into the inside of the copper tube 17 being formed in the extrusion process. The protective gas is drawn from a gas tank 33 via a shut-off valve 31 and an adjustable throttle valve 32. The shut-off valve 31 may be operated by means of a time advance switch 34. The adjustable throttle valve 32 is controllable as required via an extrusion speed measurement facility 35. This extrusion speed measurement facility may also be used to adjust the speed of the reel 23.

Figure 2:
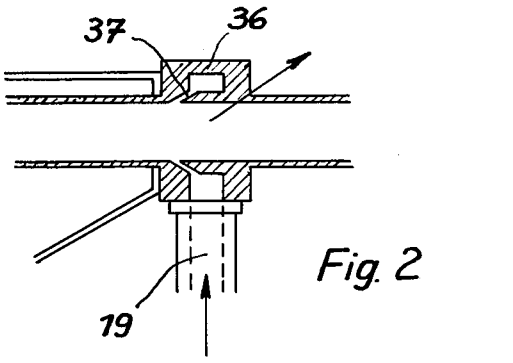
FIG. 2 shows, on an enlarged scale, a coolant supply facility in the form of a ring of jets at the farther end of the cooling section.
Figure 4:
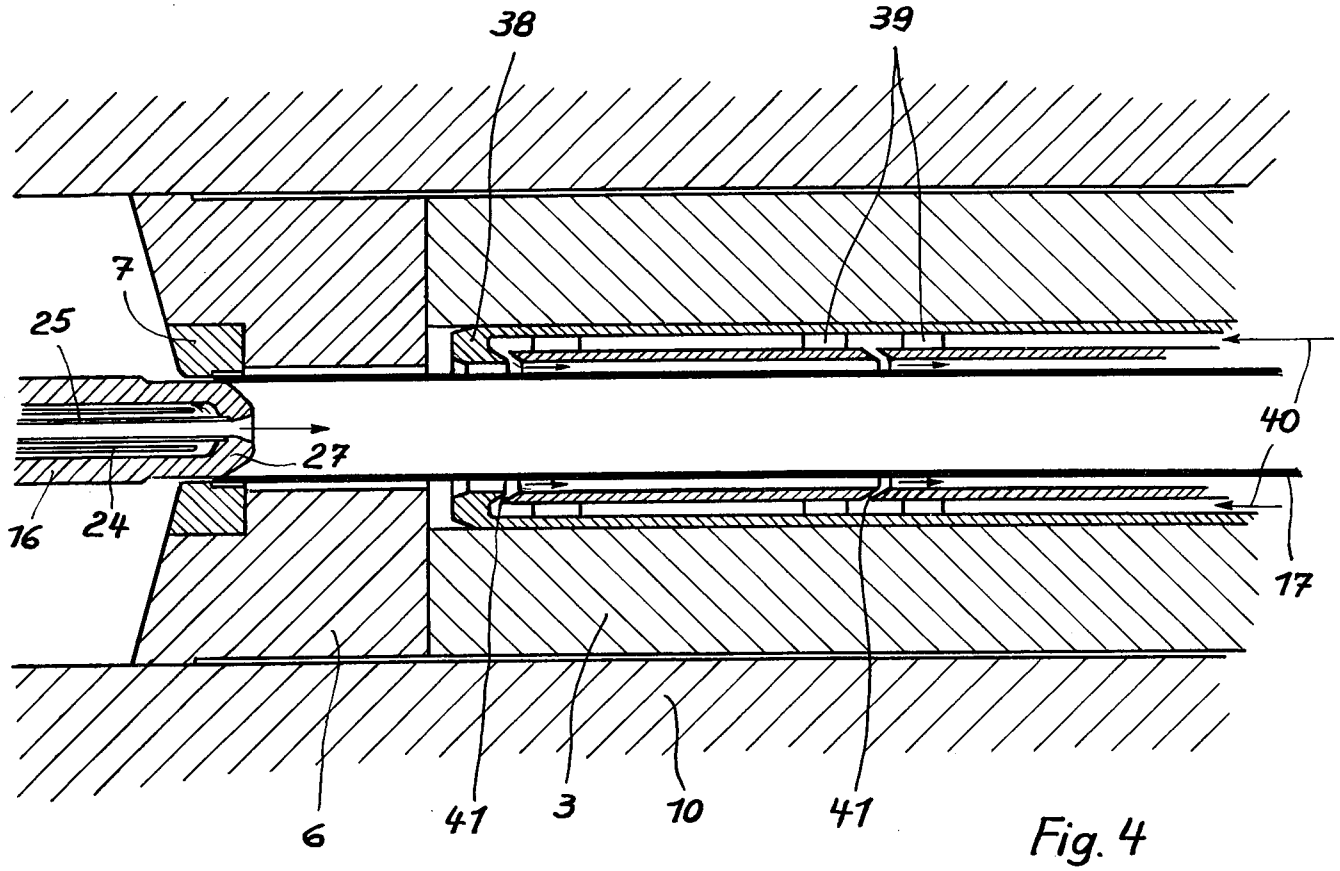
FIG. 4 shows the mandrel tip within the die and the cooling section in the hollow stem immediately downstream of the die.

The supply of cooling water at the end of the water cooling section 18 and at the start of the cooling section is more clearly shown in FIGS. 2 and 4. In FIG. 2, the cooling water outlet 19 takes the form of a ring 36 with jets 37 arranged diagonally in a direction opposite to the extrusion direction. In FIG. 4, the water cooling section is shown as a twin-walled tube 38, the two parts of the tube being linked by distance pieces 39. Cooling water is supplied as shown by the arrows 40 into the twin-tube 38. The cooling water is conveyed within the hollow stem 3 directly around the outside of the extruded copper tube 17, by means of jets 41 arranged diagonally in the direction of extrusion.

Figure 5:
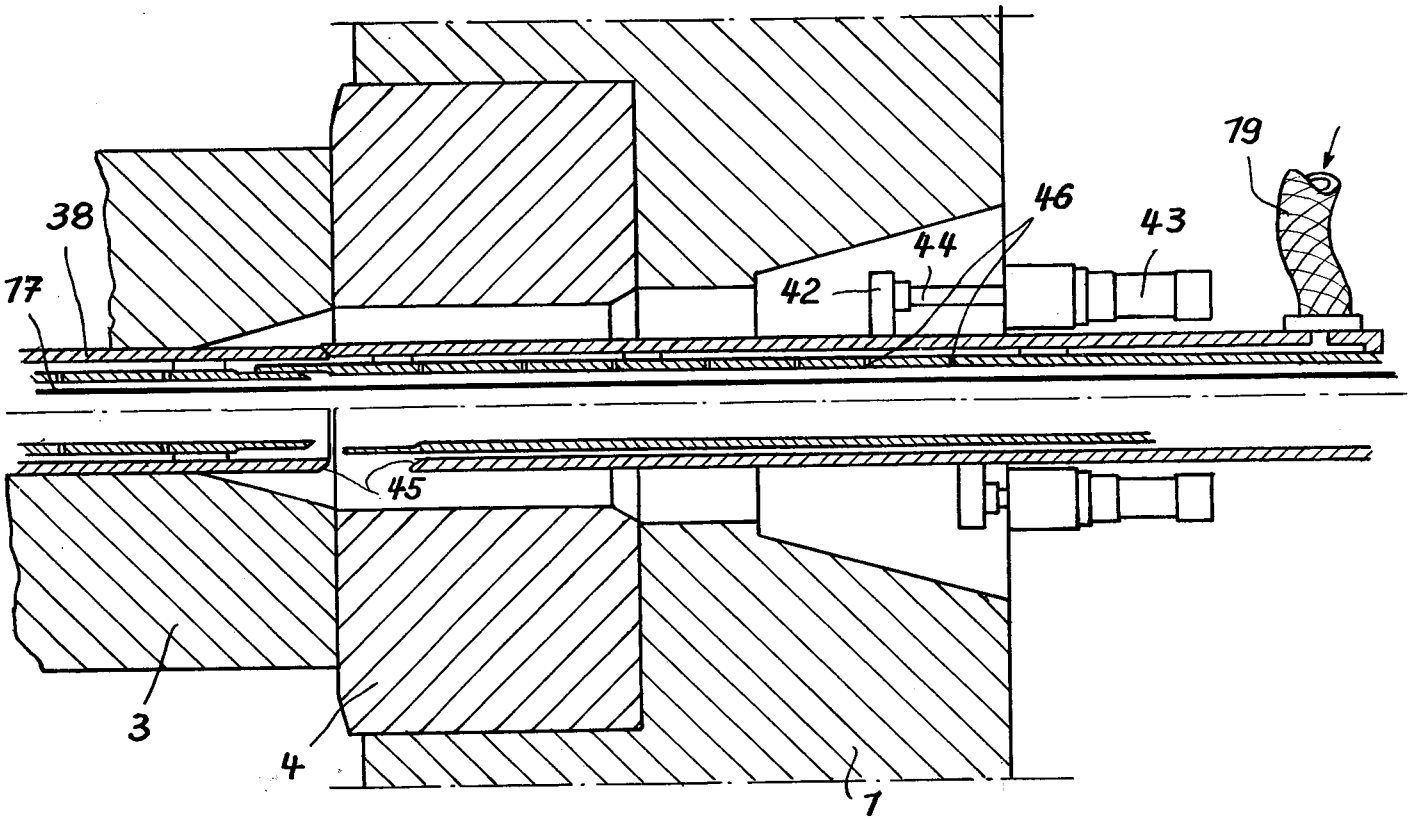
FIG. 5 shows the cooling section with tube guide separable between hollow stem and counter platen in linked and separated states.

In FIG. 5, the cooling section 18 between the hollow stem 3 and the counter platen 1 is of separable design so that the hollow stem 3 can be separated without difficulty from the counter platen 1 or pressure plate 4, or may also be moved at right angles to the direction of extrusion.

The twin-tube 38 has a support 42 in the area beyond the counter platen 1. A hydraulic piston cylinder unit 43 is fitted on the counter-platen 1 itself, its plunger 44 being linked to the support 42. The twin-tube 38 is fitted with conical joint faces at the separating point of the hollow stem 3 and the pressure plate 4. In the upper section of FIG. 5, the twin-tube is hydraulically linked by means of the piston cylinder unit 43. In the lower section of FIG. 5, the twin-tube 38 is shown separated at the point where the hollow stem 3 joins the pressure plate 4. In addition, further jets 46 are fitted in the inner tube area of the twin-tube to admit fluid to the extruded copper pipe 17.

We claim:

1. A method of extruding tubes of easily oxidised material from heated billets with central axial bores through an annular gap formed by an extrusion die and the tip of a hollow mandrel positioned in the die aperture, the method comprising the following steps:

placing the billet in a billet container of an extrusion press;

pressing the mandrel into the billet along the bore thereof, the mandrel having a diameter greater than the diameter of the bore so that the bore is widened as the mandrel is pressed in;

terminating the preceeding step once the leading end of the mandrel has entered the die aperture;

extruding the billet;

blowing protective gas into the interior of the extruded hollow tube through the mandrel; and cooling the extruded tube in a cooling section arranged immediately downstream of the die around the outside of the tube, with the protective gas remaining inside the tube up to the end of the cooling section distal from the die.

2. A method as claimed in claim 1, wherein the extruded tube is sprayed on the outside with a lubricant emulsion after passing through the cooling section.

3. A method as claimed in claim 1, wherein lubricant emulsion is passed through the mandrel at the end of extrusion to the inside of the extruded tube to coat the inner walls of the tube, and excess emulsion is subsequently expelled by air.

* * * * *